US006534697B1

(12) United States Patent
Ko

(10) Patent No.: US 6,534,697 B1
(45) Date of Patent: Mar. 18, 2003

(54) CANTILEVERED TAIL BLOCK/TAILPIECE FOR AN ACOUSTIC GUITAR

(76) Inventor: Kevin K. Ko, 1210 Risden Pl., Eugene, OR (US) 97404

( * ) Notice: Subject to any disclaimer, the term of this patent is extended or adjusted under 35 U.S.C. 154(b) by 0 days.

(21) Appl. No.: 10/147,649

(22) Filed: May 16, 2002

Related U.S. Application Data

(60) Provisional application No. 60/291,711, filed on May 18, 2001.

(51) Int. Cl.[7] ..... G10D 3/00
(52) U.S. Cl. ..... 84/299
(58) Field of Search ..... 84/299, 298, 300, 84/301, 302

(56) References Cited

U.S. PATENT DOCUMENTS 5,260,505 A * 11/1993 Kendall ..... 84/298
5,679,910 A * 10/1997 Steinberger et al. ..... 84/291
5,780,758 A * 7/1998 McGill ..... 84/296

* cited by examiner

*Primary Examiner*—Kim Lockett

(57) ABSTRACT

A cantilevered tail block/tailpiece for use with a stringed instrument such as an acoustic guitar. The tail block subassembly includes a tail block having first and second side edges, upper and lower edges, and inner and outer major planar surfaces. A cantilever having upper and lower surfaces, first and second side edges and front and rear ends extends outwardly from and substantially perpendicular to the outer major planar surface of the tail block. At least one support arm extends between the cantilever and tail block.

11 Claims, 3 Drawing Sheets

CANTILEVERED TAIL BLOCK/TAILPIECE FOR AN ACOUSTIC GUITAR

CROSS-REFERENCE TO RELATED APPLICATIONS

This application claims the benefit of U.S. Provisional Application No. 60/291,711, filed May 18, 2001.

BACKGROUND OF THE INVENTION

This invention relates to a cantilevered tail block/tailpiece for use with acoustic guitars and other stringed instruments.

The present invention specifically addresses a problem in the current design of the acoustic guitar which has not been satisfactorily addressed by prior devices. The problem arises from the fact that the six strings of a typically designed steel string acoustic guitar will impose a combined tension load on the guitar's top in excess of 150 pounds. The tension imposed by the strings causes the top of the guitar to twist and warp.

Previous attempted solutions involve attaching braces to the underside of the top. Such braces introduce their own set of problems. While strengthening the top, such braces also add weight to the top and affect the sound producing capabilities of the guitar. A guitar that is braced too heavily will sound dull and non-responsive.

Some guitar makers use tailpieces in addition to top bracing. By attaching the tailpiece to the tail block of the guitar and attaching the strings to the tailpiece, the tension of the strings on the top is reduced to approximately 16 pounds. This allows the builder to reduce the top bracing. However, the current technology of guitar tailpiece design does not provide for increasing the angle of the strings over the bridge beyond what the geometry of the guitar will allow. The angle described by the string ahead of the bridge and the string behind the bridge is called the "break angle" of the string. Current guitar design provides for a shallow break angle of about 170–180 degrees when a tailpiece is used. Somewhat deeper break angles of about 155–165 degrees are possible on guitars without tailpieces. A deeper break angle provides a more efficient transmission of string energy to the top of the guitar, and aids in sustain, tone and volume.

It is an object of the present invention to utilize the tension reducing properties of a tailpiece while deepening the break angle of the strings beyond what the geometry of the guitar would normally allow.

SUMMARY OF THE PRESENT INVENTION

In traditional tailpiece guitar design, the rear of the tailpiece is attached to the tail block and the strings are attached to the front of the tailpiece. The front end of the tailpiece "floats" over the body of the guitar, i.e., is not attached to the body of the guitar, the angle of such "float" determining the string break angle.

On a guitar incorporating the cantilevered tail block subassembly of the present invention, the tailpiece is attached to the tail block subassembly at the rear end and also at the front end immediately behind the string attachment point. This second point of attachment serves to pull the tailpiece down closer to the top of the guitar, effectively increasing the break angle of the strings over the saddle.

The tailpiece of the present invention does not attach to or rest on the top of the guitar. Machine screws are attached to the tailpiece and pass through small holes in the top of the guitar, fastening directly to a cantilevered tail block. The tailpiece is not tightened snug against the top of the guitar, but is tightened against spacers which keep the tailpiece clear of the top. By using this method of construction, the sound generating properties of the guitar top are not restricted by contact with the tailpiece, and the rigidity of the mounting system enhances "sustain".

The structural advantages of the cantilevered tail block/tailpiece of the present invention are maintained without generating deficiencies in tone, volume and sustain. The tail block of the present invention also provides a secure, rigid mounting platform for vibrato and tremolo style tailpieces.

The cantilevered tail block/tailpiece of the present invention includes a tail block subassembly and a tailpiece subassembly.

The tail block subassembly includes a tail block having first and second side edges, upper and lower edges, and inner and outer major planar surfaces. A cantilever having upper and lower surfaces, first and second side edges and front and rear ends extends outwardly from and substantially perpendicular to the outer major planar surface of the tail block. At least one support arm extends between the cantilever and tail block.

DESCRIPTION OF PREFERRED EMBODIMENTS

Figure 1:
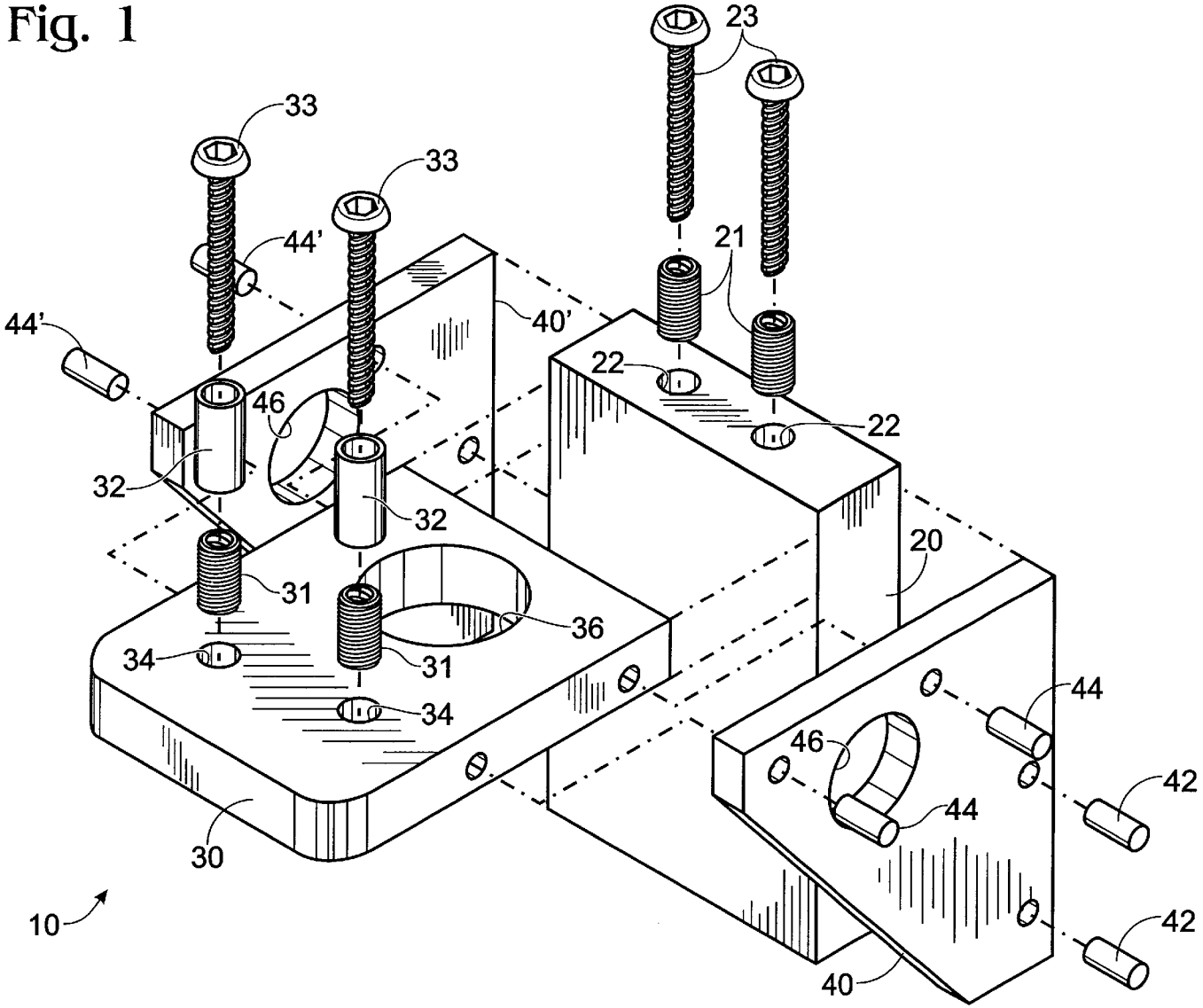
FIG. 1 is an exploded front perspective view of the tail block subassembly of the present invention.
Figure 2:
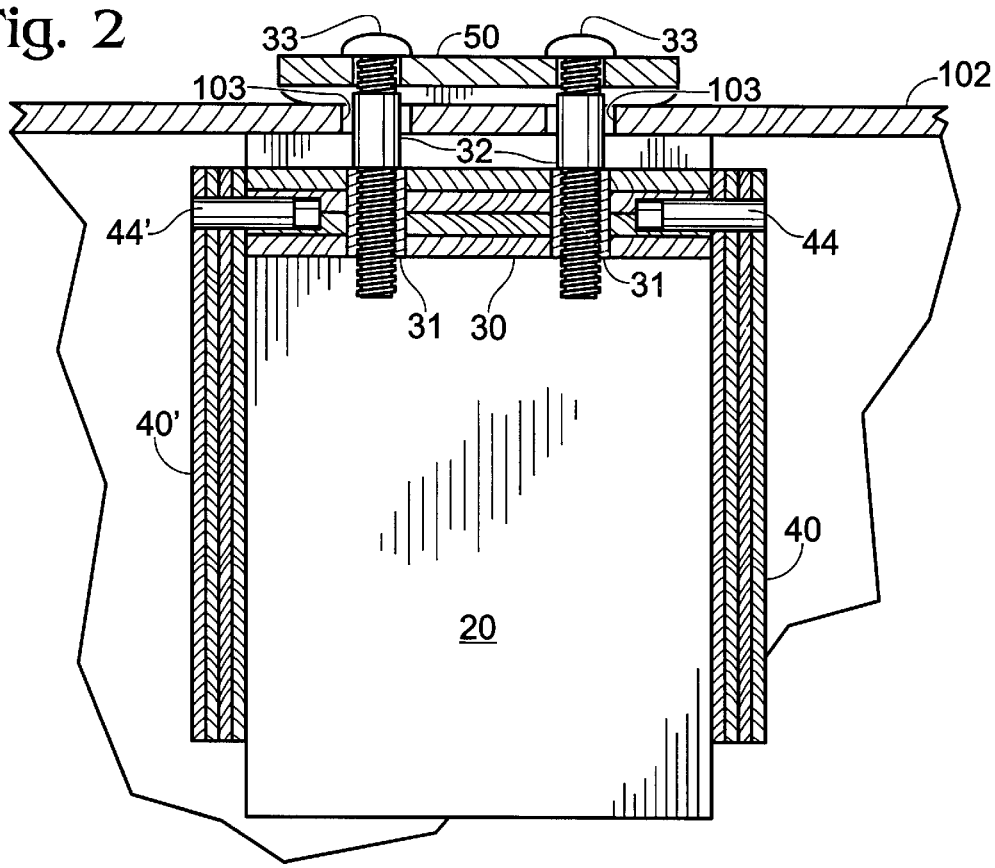
FIG. 2 is a cross-sectional front elevation view of the tail block/tailpiece device of the present invention.
Figure 3:
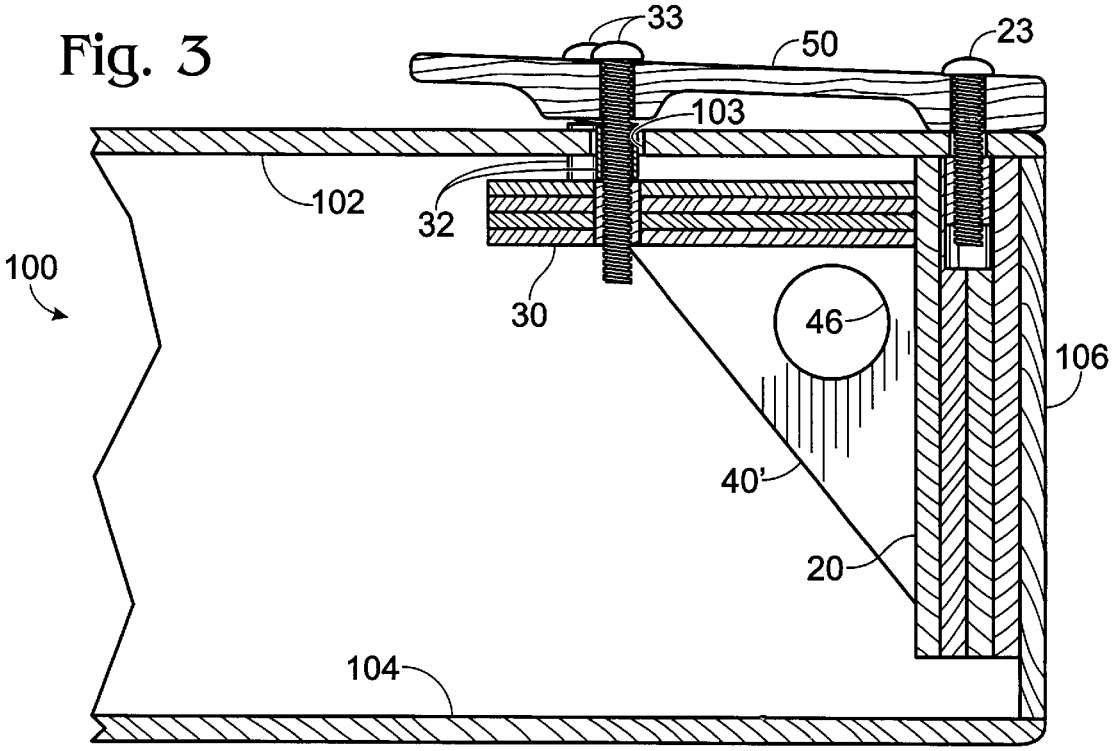
FIG. 3 is a cross-sectional side elevation view of the tail block/tailpiece device of the present invention.

The cantilevered tail block/tailpiece device of the present invention addresses tonal problems and deficiencies associated with shallow string break angles in prior art tailpiece designs for guitars.

The cantilevered tail block/tailpiece device of the present invention is incorporated into current guitar design and build processes. It cannot be retrofitted into an existing guitar.

The cantilevered tail block/tailpiece device of the present invention expands the tonal capability of tailpiece guitars by allowing more energy to be transmitted from the strings to the top of the guitar.

The cantilevered tail block/tailpiece device of the present invention does not add any mass to the top of the guitar, and does not impede or otherwise restrict the ability of the top to generate sound.

The cantilevered tail block/tailpiece device of the present invention does not significantly alter the outward appearance of the tailpiece guitar, and lends itself to modification and customization by the guitar builder.

The cantilevered tail block/tailpiece device of the present invention may be used on all types of hollow bodied guitars, including acoustic steel string, classical nylon string, acoustic bass and acoustic-electric guitars. It may also be applied to other stringed instruments faced with similar design problems, such as mandolins, ukeleles and lutes. It is adaptable to virtually all shapes and sizes of hollow bodied stringed instruments, and is customizable to meed the needs and desires of builders and players.

The cantilevered tail block subassembly 10 of the present invention includes a tail block 20, a cantilever 30 and a pair of gussets 40, 40'. Cantilevered tail block subassembly 10 is located within the interior of a guitar 100 having a top 102, a bottom 104, rear wall 106 and a plurality of strings 108.

Tail block 20 is glued to the inside of the rear wall 106 of guitar 100 at its mid-portion.

Cantilever 30 is glued to tail block 20, and is supported along its side edges by identical support arms (gussets) 40, 40'. Gussets 40, 40' are glued to tail block 20, and additionally secured to tail block 20 by wooden dowel pins 42, 42', which are glued into place. Gussets 40, 40' are glued to cantilever 30 and additionally secured to cantilever 30 by wooden dowel pins 44, 44', which are glued into place. Gussets 40, 4' serve to brace the cantilevered tail block subassembly 10 against the upward pull exerted by strings 108 on tailpiece 50.

Holes 46 are drilled through gussets 40, 40', respectively, to reduce any baffling effect the gussets may produce. Similarly hole 36 is drilled through cantilever 30 to reduce any such baffling effect.

Threaded brass inserts 31 are set into holes 34 drilled into cantilever 30, and accept long machine screws 33 that pass through long aluminum spacers 32. Machine screws 33 fasten the tailpiece 50 to cantilever 30 of tail block subassembly 10.

Similarly, threaded brass inserts 21 may also be set into holes 22 drilled into the tail block 20 to accept short machine screws 23 used to secure the rear of the tailpiece 50. Alternatively, wood screws may be substituted for machine screws 23 to eliminate the need for the threaded brass inserts 21.

The complete cantilevered tail block subassembly 10 is rigidly mounted to the inside of the guitar 100 as a normal tail block would be mounted. Holes 103 must be drilled through the top of the guitar to allow for the machine screws and long aluminum spacers 32 to pass through the top 102 of the guitar 100 without touching the top 102. This is important as it preserves the sound generating capabilities of the top 102.

Tailpiece 50 may be made out of a variety of materials, such as wood, metal, composites or any combination that will yield a pleasing design and rigid structure to which the strings 108 will be attached. The tailpiece 50 must be strong and rigid enough to withstand the force exerted on it by the strings 108. The tailpiece must also be designed to accept a minimum of two machine screws 33 that will connect it to the cantilevered tail block subassembly 10. Optimally, the screws 33 will be positioned at some point immediately behind the fastening point of strings 108. Alternatively, the screws 33 may be positioned forward of the string mounting point if the design of the tailpiece 50 can accommodate this configuration. The rear end of the tailpiece 50 may be fastened to the tail block 20 in any one of several traditional methods. However, it is recommended that threaded brass inserts 31 be used as this allows the tailpiece 50 to be installed and removed multiple times without damaging the tail block 20.

Figure 4:
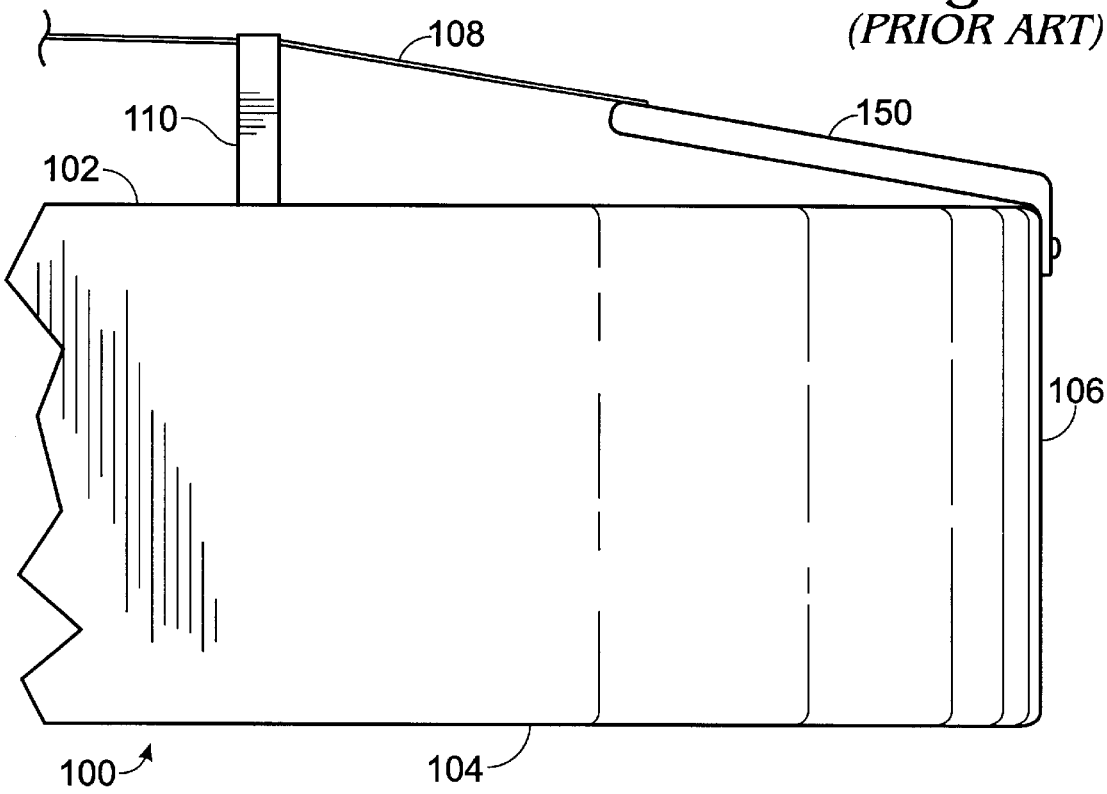
Fig. 4 (PRIOR ART)
FIG. 4 is a partial side elevation of a guitar showing the string break angle of a prior art tailpiece device.
Figure 5:
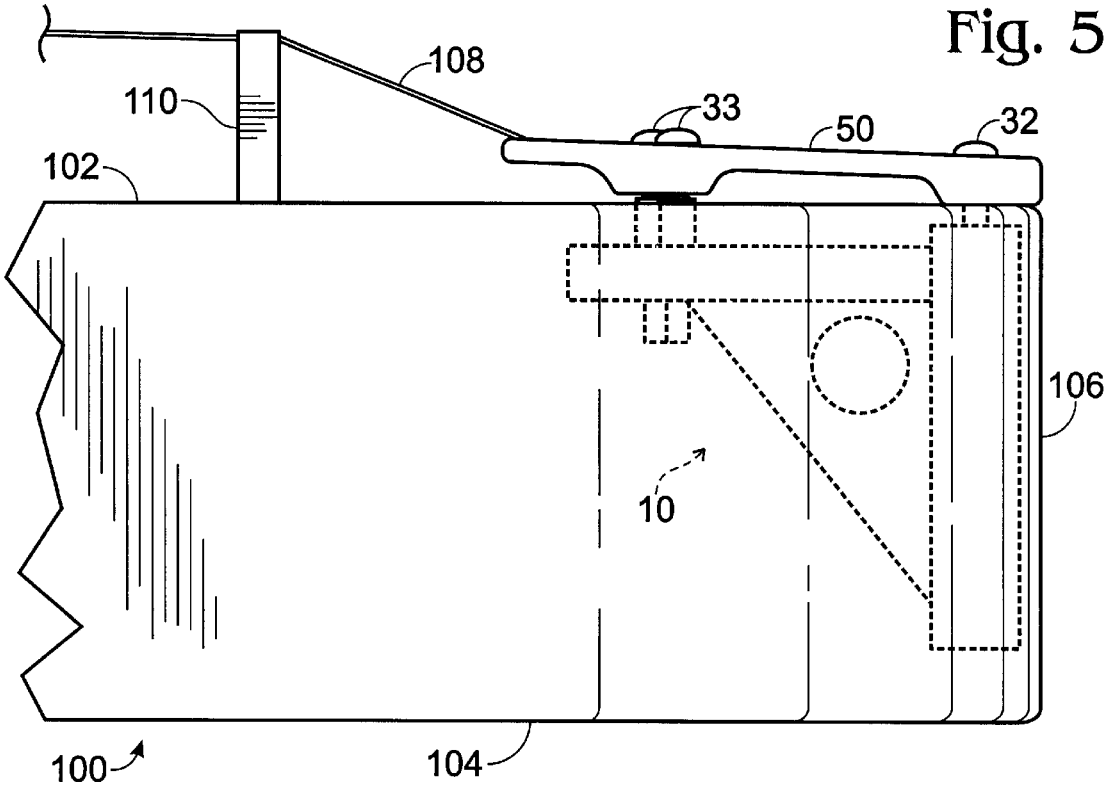
FIG. 5 is a partial side elevation of a guitar showing the string break angle of the tail block/tailpiece device of the present invention.

It should be noted that the main structural securing points are those at the rear end of the tailpiece 50, and that the machine screws 33 near the front end serve only to pull the tailpiece 50 down toward the top 102 of guitar 100 and increase the break angle of the strings 108 over bridge 110 (as seen in FIG. 5) versus the prior art tailpiece 150 providing the break angle shown in FIG. 4.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A tail block subassembly for use with a stringed instrument comprising:

a tail block having first and second side edges, upper and lower edges, and inner and outer major planar surfaces;

a cantilever having upper and lower surfaces, first and second side edges and front and rear ends, said cantilever extending outwardly from and substantially perpendicular to said outer major planar surface of said tail block; and at least one support arm extending from said cantilever to said tail block.

2. The tail block subassembly of claim 1 wherein there are two support arms.

3. The tail block subassembly of claim 2 wherein said support arms are generally right triangular-shaped gussets having a base attached to said tail block and a side perpendicular to said base attached to said cantilever.

4. The tail block subassembly of claim 3 wherein each of said gussets have a baffling reducing hole in the mid-portion thereof.

5. The tail block subassembly of claim 1 wherein said cantilever has a baffling reducing hole in the mid-portion thereof.

6. In a stringed instrument having a top surface having front and rear ends, a bottom surface having front and rear ends, and front, side and rear walls having inner and outer surfaces extending between said top and bottom surfaces, a tail block subassembly attached to the inner surface of said rear wall and a tailpiece subassembly attached to the rear end of said top surface, the improvement comprising:

a tail block subassembly including:

a tail block having first and second side edges, upper and lower edges, and inner and outer major planar surfaces;

a cantilever having upper and lower surfaces, first and second side edges and front and rear ends, said cantilever extending outwardly from and substantially perpendicular to said outer major planar surface of said tail block; and at least one support arm extending from said cantilever to said tail block; and a tailpiece subassembly having front and rear ends, said tailpiece being attached adjacent its rear end to said tail block of said tail block subassembly and attached adjacent its front end to said cantilever of said tail block subassembly.

7. The stringed instrument of claim 6 wherein said cantilever has internally threaded inserts embedded in its upper surface and said tail block has internally threaded inserts in its upper edge, said tailpiece subassembly being attached to said cantilever adjacent its front end by means of threaded fasteners extending through openings in the top of said stringed instrument and into said internally threaded inserts located in said cantilever, said tailpiece subassembly being attached to said tail block adjacent its rear end by means of threaded fasteners extending through openings in the top of said stringed instrument and into said internally threaded inserts located in said tail block, in a manner such that none of said threaded fasteners contact said top surface of said stringed instrument.

8. The tail block subassembly of claim 6 wherein said tail block subassembly has two support arms.

9. The tail block subassembly of claim 8 wherein said support arms are generally right triangular-shaped gussets having a base attached to said tail block and a side perpendicular to said base attached to said cantilever.

10. The tail block subassembly of claim 9 wherein each of said gussets have a baffling reducing hole in the mid-portion thereof.

11. The tail block subassembly of claim 6 wherein said cantilever has a baffling reducing hole in the mid-portion thereof.

* * * * *